US008305299B2

(12) United States Patent
Cho et al.

(10) Patent No.: US 8,305,299 B2
(45) Date of Patent: Nov. 6, 2012

(54) PLASMA DISPLAY DEVICE

(75) Inventors: Sung Kwang Cho, Gumi-si (KR); Yun Kwon Jung, Gumi-si (KR); Kyung Ryeol Shim, Gumi-si (KR); Yang Ki An, Gumi-si (KR)

(73) Assignee: LG Electronics Inc., Seoul (KR)

( * ) Notice: Subject to any disclaimer, the term of this patent is extended or adjusted under 35 U.S.C. 154(b) by 1036 days.

(21) Appl. No.: 12/264,933

(22) Filed: Nov. 5, 2008

(65) Prior Publication Data

US 2009/0128537 A1 May 21, 2009

(30) Foreign Application Priority Data

Nov. 15, 2007 (KR) ..... 10-2007-0116676
Nov. 15, 2007 (KR) ..... 10-2007-0116677

(51) Int. Cl.
*G09G 3/28* (2006.01)

(52) U.S. Cl. ..... 345/60; 315/169.4; 313/582

(58) Field of Classification Search ..... 345/41, 345/42, 60, 63, 68, 204, 214; 315/169.1, 315/169.2, 169.3, 169.4; 313/582
See application file for complete search history.

(56) References Cited

U.S. PATENT DOCUMENTS 7,592,973 B2 * 9/2009 Choi ..... 345/60

* cited by examiner

*Primary Examiner* — Abbas Abdulselam
(74) *Attorney, Agent, or Firm* — Fish & Richardson P.C.

(57) ABSTRACT

There is provided a plasma display device using a driving device for supplying driving signals to a plasma display panel (PDP). In a sustain falling period that at least partially overlaps the rising period of reset signals supplied to scan electrodes formed on the PDP, a voltage supplied to sustain electrodes is gradually reduced and a positive polar voltage is supplied to address electrodes. In driving the PDP, gradually falling signals are supplied to the sustain electrodes in the rising period of the reset signals so that the driving margin of the PDP can be secured. The positive polar voltage is supplied to the address electrodes so that initialization discharge can be stably performed and that the erroneous discharge of the plasma display device can be reduced.

20 Claims, 11 Drawing Sheets

PLASMA DISPLAY DEVICE

BACKGROUND OF THE INVENTION

1. Field of the Invention

The present invention relates to a plasma display device, and more particularly, to a method of driving a plasma display panel (PDP).

2. Discussion of the Related Art

A plasma display panel (PDP) excites a phosphor by vacuum ultraviolet rays (VUV) generated when mixtures of inert gases are discharged to emit light and to display an image.

The PDP can be easily made large, thin, and simple so that the PDP can be easily manufactured and has higher brightness and emission efficiency than other flat panel displays (FPD). In particular, since an alternate current (AC) surface discharge type three electrode PDP has wall charges accumulated on the surface thereof during discharge to protect electrodes from sputtering generated by the discharge, the AC surface discharge type three electrode PDP is driven at a low voltage and has a long life.

The PDP is time division driven in a reset period for initializing all of the cells, an address period for selecting a cell, and a sustain period for generating display discharge in the selected cell in order to realize the gradations of an image.

When all of the electrodes are not initialized to a wall charge state for addressing in the reset period, erroneous discharge can be generated or discharge may not be generated in the address period. Therefore, the picture quality of a displayed image is deteriorated.

SUMMARY OF THE INVENTION

In order to solve the above-described problems, it is an object of the present invention to provide a plasma display device capable of effectively initializing discharge cells before addressing to stably drive a plasma display panel (PDP) in a panel driving device included in a plasma display device.

In order to achieve the above object, the plasma display device according to the present invention includes a plasma display panel (PDP) including a plurality of scan electrodes and sustain electrodes formed on an upper substrate and a plurality of address electrodes formed on a lower substrate. Reset signals supplied to the scan electrodes include a rising period that rises from a first voltage to a third voltage. The rising period includes a first rising period that rises from the first voltage to a second voltage and a second rising period that rises with a smaller slope than the first rising period from the second voltage to the third voltage. In at least one of a plurality of subfields that constitute one frame, a voltage supplied to the sustain electrodes in a sustain falling period that at least partially overlaps the rising period is gradually reduced from a fourth voltage to a fifth voltage and a sixth voltage is supplied to the address electrodes in the sustain falling period.

DETAILED DESCRIPTION OF THE PREFERRED EMBODIMENTS

Figure 1:
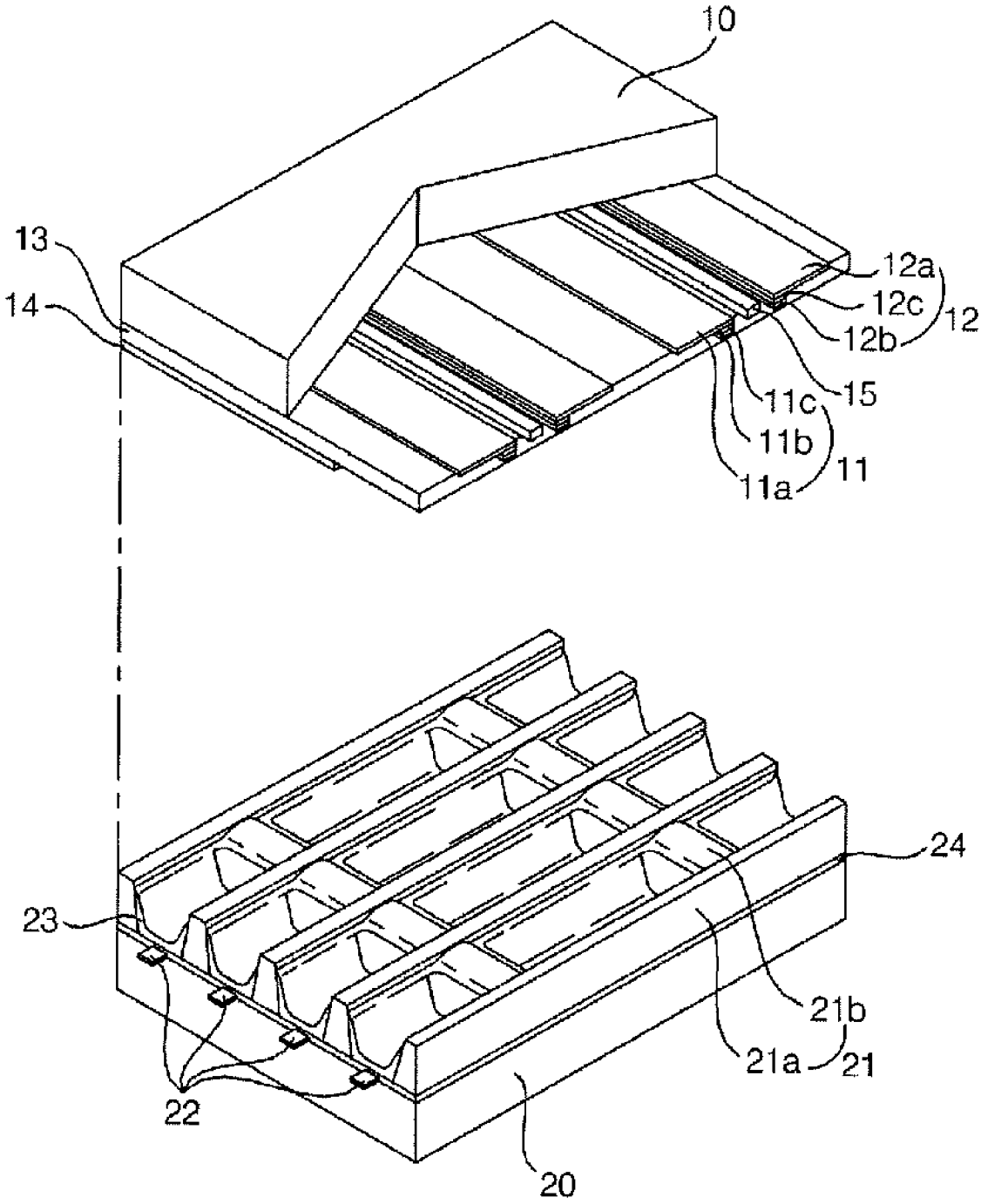
FIG. 1 is a perspective view illustrating the structure of a plasma display panel (PDP) according to an embodiment of the present invention.

Hereinafter, a plasma display device according to the present invention will be described in detail with reference to the accompanying drawings. FIG. 1 is a perspective view illustrating the structure of a plasma display panel (PDP) according to an embodiment of the present invention.

As illustrated in FIG. 1, the PDP includes scan electrodes 11 and sustain electrodes 12 that are pairs of sustain electrodes formed on an upper substrate 10 and address electrodes 22 formed on a lower substrate 20.

The pairs of sustain electrodes 11 and 12 commonly include transparent electrodes 11*a* and 12*a* and bus electrodes 11*b* and 12*b* formed of indium tin oxide (ITO). The bus electrodes 11*b* and 12*b* can be formed of metal such as Ag and Cr, a lamination of Cr/Cu/Cr, or a lamination of Cr/Al/Cr. The bus electrodes 11*b* and 12*b* are formed on the transparent electrodes 11*a* and 12*a* to reduce reduction in a voltage that is caused by the transparent electrodes 11*a* and 12*a* having high resistance.

On the other hand, according to an embodiment of the present invention, the pairs of sustain electrodes 11 and 12 can be formed of only the bus electrodes 11*b* and 12*b* without the transparent electrodes 11*a* and 12*a* as well as a lamination of the transparent electrodes 11*a* and 12*a* and the bus electrodes 11*b* and 12*b*. In such a structure, since the transparent electrodes 11*a* and 12*a* are not used, the cost of manufacturing the PDP can be reduced. The bus electrodes 11*b* and 12*b* used for the structure can be formed of various materials such as a photosensitive material other than the above mentioned materials.

Black matrixes BM 15 having a light shielding function of absorbing external light generated in the outside of the upper substrate 10 to reduce reflection and a function of improving the purity and contrast of the upper substrate 10 are provided between the transparent electrodes 11*a* and 12*a* and the bus electrodes 11*b* and 11*c* of the scan electrodes 11 and the sustain electrodes 12.

The black matrixes 15 according to an embodiment of the present invention are formed on the upper substrate 10 and can consist of first black matrixes 15 formed to overlap barrier ribs 21 and second black matrixes 11*c* and 12*c* formed between the transparent electrodes 11*a* and 12*a* and the bus electrodes 11*b* and 12*b*. Here, the first black matrixes 15 and the second black matrixes 11*c* and 12*c* referred to as a black layer or a black electrode layer can be simultaneously formed to be physically connected to each other and may not be simultaneously formed not to be physically connected to each other.

In addition, when the first black matrixes 15 and the second black matrixes 11*c* and 12*c* are physically connected to each other, the first black matrixes 15 and the second black matrixes 11*c* and 12*c* are formed of the same material. However, when the first black matrixes 15 and the second black matrixes 11*c* and 12*c* are physically separated from each other, the first black matrixes 15 and the second black matrixes 11*c* and 12*c* can be formed of different materials.

An upper dielectric layer 13 and a protective layer 14 are laminated on the upper substrate 10 where the scan electrodes 11 and the sustain electrodes 12 run parallel to each other. Charged particles generated by discharge are accumulated on the upper dielectric layer 13 to protect the pairs of sustain electrodes 11 and 12. The protective layer 14 protects the upper dielectric layer 13 against the sputtering of the charged particles generated during gas discharge and improves the emission efficiency of secondary electrons.

In addition, the address electrodes 22 are formed to intersect the scan electrodes 11 and the sustain electrodes 12. In addition, a lower dielectric layer 24 and the barrier ribs 21 are formed on the lower substrate 20 where the address electrodes 22 are formed.

In addition, phosphor layers 23 are formed on the surfaces of the lower dielectric layer 24 and the barrier ribs 21. The barrier ribs 21 in which vertical barrier ribs 21*a* and horizontal barrier ribs 21*b* are formed to be closed physically divide discharge cells from each other and prevent the ultraviolet (UV) rays and visible rays generated by discharge from leaking to adjacent discharge cells.

According to an embodiment of the present invention, the barrier ribs 21 can have various structures as well as the structure illustrated in FIG. 1. For example, the barrier ribs 21 can have a differential barrier rib structure in which the height of the vertical barrier ribs 21*a* is different from the height of the horizontal barrier ribs 21*b*, a channel type barrier rib structure in which a channel that can be used as an exhaust path is formed in at least one of the vertical barrier ribs 21*a* and the horizontal barrier ribs 21*b*, and a hollow type barrier rib structure in which a hollow is formed in at least one of the vertical barrier ribs 21*a* and the horizontal barrier ribs 21*b*.

Here, in the differential barrier rib structure, the height of the horizontal barrier ribs 21*b* is preferably higher than the height of the vertical barrier ribs 21*a*. In the channel type barrier rib structure or the hollow type barrier rib structure, the channel or the hollow is preferably formed in the horizontal barrier ribs 21*b*.

On the other hand, according to an embodiment of the present invention, it is described that R, G, and B discharge cells are arranged on the same line, however, can be arranged in other forms. For example, delta type arrangement in which the R, G, and B discharge cells are triangularly arranged can be performed. In addition, the shape of the discharge cell can be various polygons such as a pentagon and a hexagon as well as a square.

In addition, the phosphor layers 23 emit light by the UV rays generated during the gas discharge to generate on visible ray among red R, green G, and blue B visible rays. Here, mixtures of inert gases such as He+Xe, Ne+Xe, and He+Ne+Xe for discharge are implanted into discharge spaces provided among the upper and lower substrates 10 and 20 and the barrier ribs 21.

Figure 2:
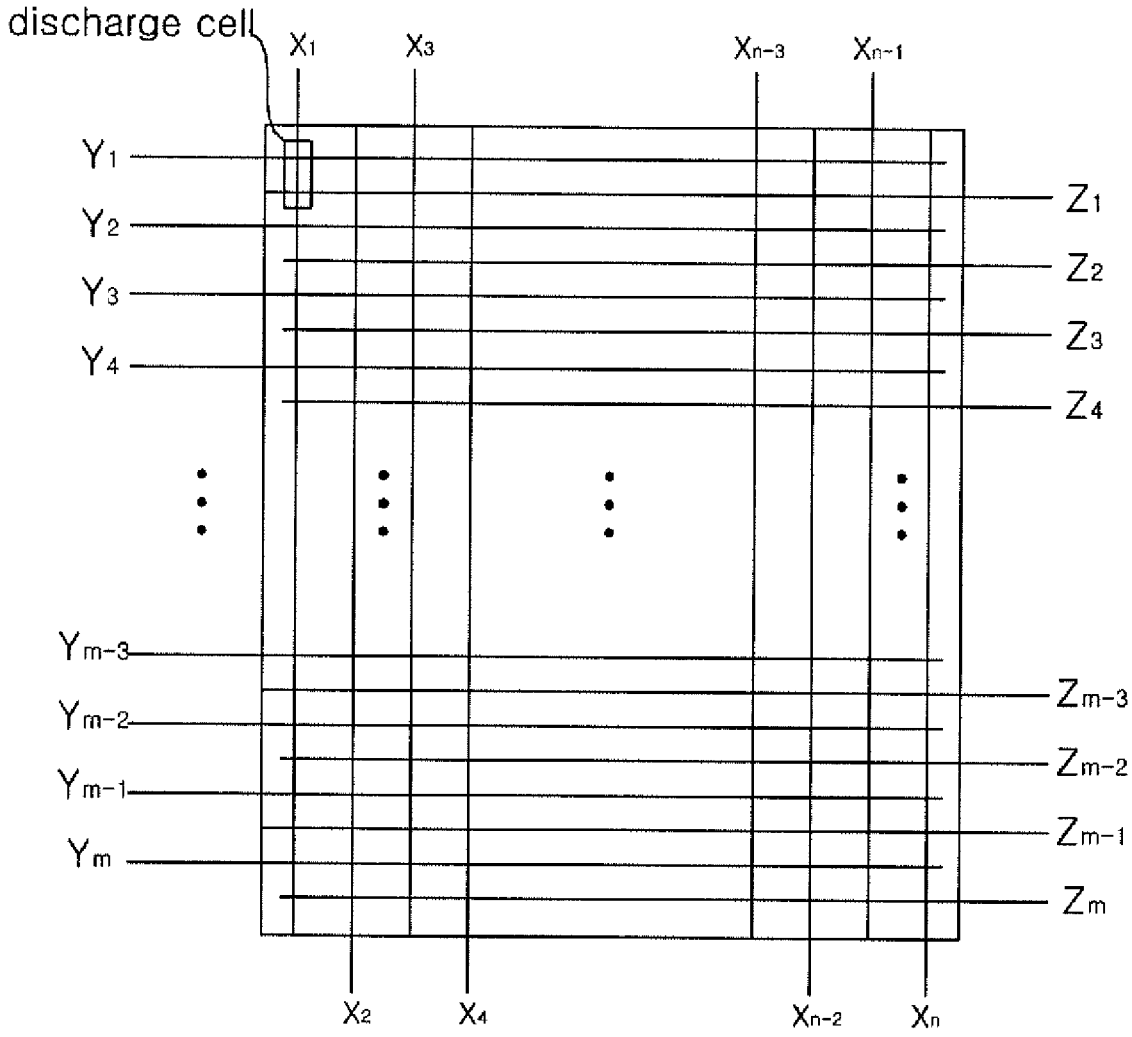
FIG. 2 is a sectional view illustrating the arrangement of the electrodes of the PDP according to an embodiment of the present invention.

FIG. 2 is a sectional view illustrating the arrangement of the electrodes of the PDP according to an embodiment of the present invention. The plurality of discharge cells that constitute the PDP, as illustrated in FIG. 2, are preferably arranged in a matrix. The plurality of discharge cells are provided in the intersections of scan electrode lines Y1 to Ym, sustain electrode lines Z1 to Zm, and address electrode lines X1 to Xn. The scan electrode lines Y1 to Ym can be sequentially or simultaneously driven and the sustain electrode lines Z1 to Zm can be simultaneously driven. The address electrode lines X1 to Xn can be divided into odd lines and even lines to be driven or can be sequentially driven.

Since the arrangement of the electrodes illustrated in FIG. 2 is only an embodiment of the arrangement of the electrodes of the PDP according to the present invention, the present invention is not limited to the arrangement of the electrodes of the PDP illustrated in FIG. 2 and the method of driving the PDP illustrated in FIG. 2. For example, a dual scan method in which two scan electrode lines among the scan electrode lines Y1 to Ym are simultaneously scanned can be performed. In addition, the address electrode lines X1 to Xn are divided into an upper part and a lower part in the center of the PDP to be driven.

Figure 3:
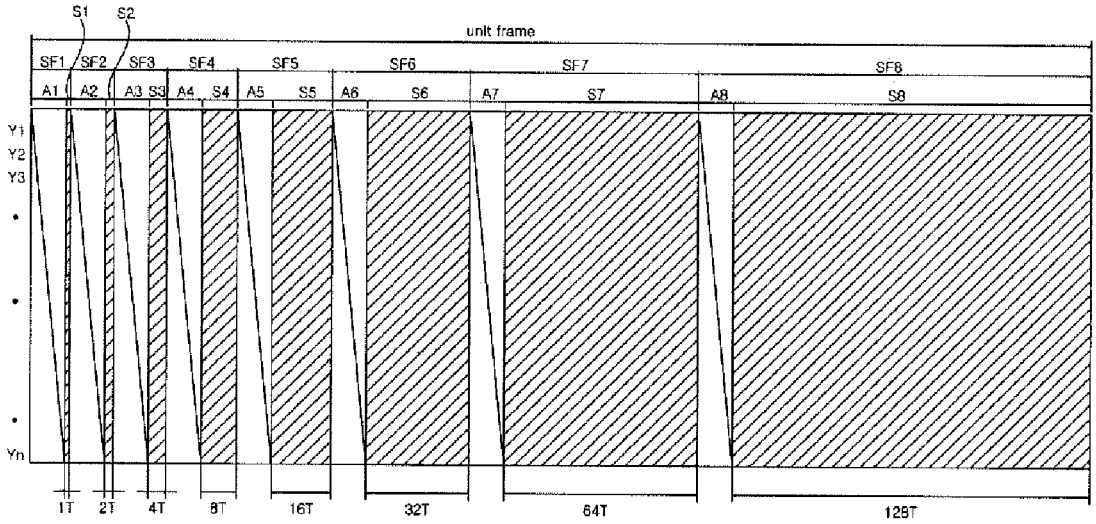
FIG. 3 is a timing diagram illustrating a method of dividing one frame into a plurality of subfields to time division drive the PDP according to an embodiment of the present invention.

FIG. 3 is a timing diagram illustrating a method of dividing one frame into a plurality of subfields to time division drive the PDP according to an embodiment of the present invention. A unit frame can be divided into a predetermined number of, for example, eight subfields SF1, . . . , and SF8 in order to display time division gradations. In addition, the subfields SF1, . . . , and SF8 are divided into reset periods (not shown), address periods A1, . . . , and A8, and sustain periods S1, . . . , and S8, respectively.

Here, according to an embodiment of the present invention, the reset period can be omitted from at least one of the plurality of subfields. For example, the reset period can exist only in an initial subfield or only in an intermediate subfield among all of the subfields.

In the address periods A1, . . . , and A8, display data signals are applied to the address electrodes X and scan pulses corresponding to the scan electrodes Y are sequentially applied.

In the sustain periods S1, . . . , and S8, sustain pulses are alternately applied to the scan electrodes Y and the sustain electrodes Z to generate sustain discharge by the discharge cells where wall charges are formed in the address periods A1, . . . , and A8.

The brightness of the PDP is in proportion to the number of sustain discharge pulses in the sustain discharge periods S1, . . . , and S8 occupied in the unit frame. When one frame that forms an image is displayed into the eight subfields and 256 gradations, different numbers of sustain pulses can be sequentially assigned to the subfields in the ratio of 1, 2, 4, 8, 16, 32, 64, and 128. In order to obtain the brightness of 133 gradations, cells are addressed in a subfield 1 period, a subfield 3 period, and a subfield 8 period to perform the sustain discharge.

The number of sustain discharges assigned to the subfields can be variably determined in accordance with the weight value of the subfields in accordance with an automatic power control (APC) step. That is, in FIG. 3 one frame is divided into the eight subfields. However, the present invention is not limited thereto and the number of subfields that constitute one frame can vary in accordance with a design. For example, one frame can be divided into no less than the eight subfields such as 12 or 16 subfields to drive the PDP.

In addition, the number of sustain discharges assigned to the subfields can vary in consideration of a gamma characteristic or a panel characteristic. For example, the degree of gradations assigned to the subfield 4 can be reduced from 8 to 6 and the degree of gradations assigned to the subfield 6 can be increased from 32 to 34.

Figure 4:
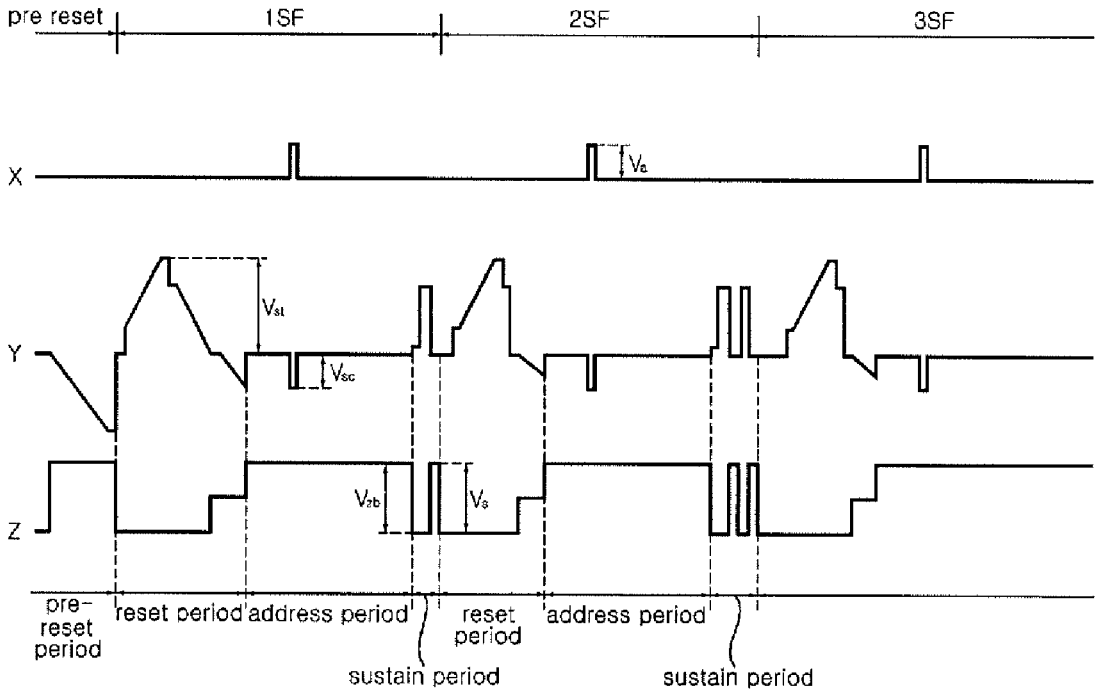
FIG. 4 is a timing diagram illustrating driving signals for driving the PDP according to an embodiment of the present invention.

FIG. 4 is a timing diagram illustrating driving signals for driving the PDP according to an embodiment of the present invention.

The subfield includes a pre-reset period for forming positive polar wall charges on the scan electrodes Y and for forming negative polar wall charges on the sustain electrodes Z, a reset period for initializing the discharge cells on the entire screen using the distribution of the wall charges formed in the pre-reset period, an address period for selecting discharge cells, and a sustain period for sustaining the discharge of the selected discharge cells.

The reset period is divided into a set up period and a set down period. In the set up period, a rising ramp waveform is simultaneously applied to all of the scan electrodes so that fine discharge is generated by all of the discharge cells and that the wall charges are generated. In the set down period, a falling ramp waveform Ramp-down that falls at a positive polar voltage lower than the peak voltage of the rising ramp waveform Ramp-up is simultaneously applied to all of the scan electrodes Y so that erase discharge is generated by all of the discharge cells and that unnecessary charges are erased among the wall charges and space charges generated by set up discharge.

In the address period, negative polar scan signals scan are sequentially applied to the scan electrodes and, at the same time, data signals data having a positive polar voltage Va are applied to the address electrodes X. Address discharge is generated by a voltage difference between the scan signals scan and the data signals data and a wall voltage generated in the reset period to select cells. On the other hand, signals that sustain a sustain voltage are applied to the sustain electrodes in the set down period and the address period.

In the sustain period, the sustain pulses having the sustain voltage Vs are alternately applied to the scan electrodes and the sustain electrodes to generate the sustain discharge in the form of surface discharge between the scan electrodes and the sustain electrodes.

The driving waveforms illustrated in FIG. 4 are only an embodiment of signals for driving the PDP according to the present invention. The present invention is not limited to the waveforms illustrated in FIG. 4. For example, the pre-reset period can be omitted, the polarity and the voltage level of the driving signals illustrated in FIG. 4 can vary if necessary, and erase signals for erasing the wall charges after the sustain discharge is completed can be applied to the sustain electrodes. In addition, single sustain driving in which the sustain signals can be applied to one of the scan electrodes Y and the sustain electrodes Z so that the sustain discharge is generated can be performed.

FIGS. 5 to 9 are timing diagrams illustrating the waveforms of panel driving signals according to embodiments of the present invention. Reset signals supplied to the scan electrodes can sequentially include a rising period s1 in which a voltage is increased to Vst, a sustain period s2 for sustaining the Vst, and a falling period s3 in which the voltage is reduced from the Vst.

Figure 5:
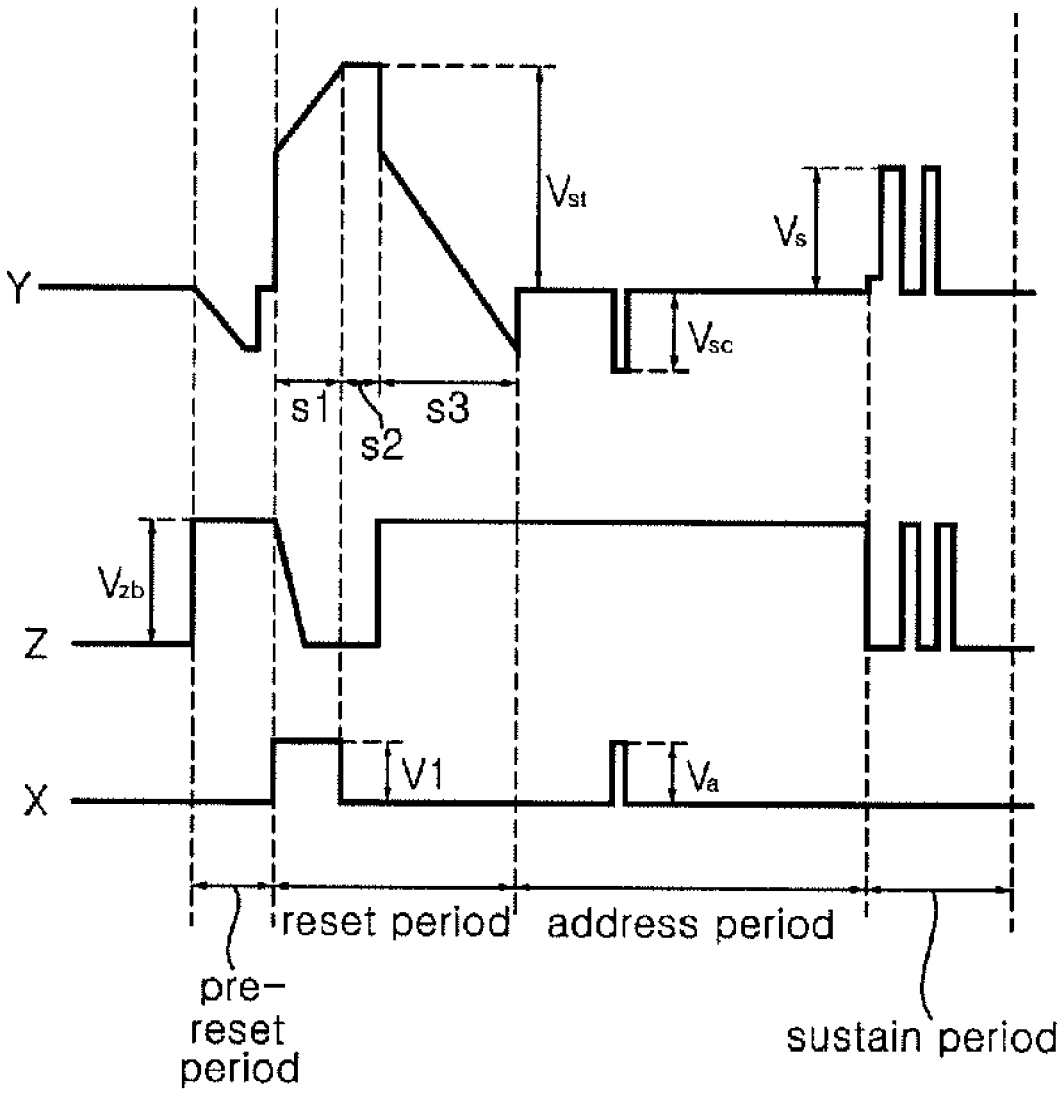
FIGS. 5 to 11 are timing diagrams illustrating the waveforms of panel driving signals according to embodiments of the present invention.

Referring to FIG. 5, signals that gradually fall are supplied to the sustain electrodes Z and signals that gradually rise are supplied to the scan electrodes Y in an at least partial period of the rising period s1 so that weak discharge is generated between the scan electrodes Y and the sustain electrodes Z. Negative polar (−) wall charges are formed in the scan electrodes Y by the weak discharge between the scan electrodes Y and the sustain electrodes Z.

As described above, in the at least partial period of the rising period s1, the signals that gradually fall are supplied to the sustain electrodes Z so that the length of the reset period can be reduced in comparison with the driving waveforms illustrated in FIG. 4 and that the driving margin of the PDP can be secured.

In order to easily constitute a driving circuit and to prevent the generation of strong discharge, the falling slope of the gradually falling signals supplied to the sustain electrodes Z can be equal to the falling slope of the voltage supplied to the scan electrodes Y in the falling period s3.

In addition, in the at least partial period of the rising period s1, a positive polar voltage V1 is supplied to the address electrodes X to prevent the generation of the discharge between the scan electrodes Y and the address electrodes X or between the sustain electrodes Z and the address electrodes X.

In order to easily constitute the driving circuit and to effectively control the generation of the discharge between the scan electrodes Y and the address electrodes X or between the sustain electrodes Z and the address electrodes X, the positive polar voltage V1 supplied to the address electrodes can be equal to the address voltage Va of data signals supplied to the address electrodes X in the address period.

Therefore, in the driving waveforms illustrated in FIG. 5, the wall charges are formed in the scan electrodes Y by the weak discharge between the scan electrodes Y and the sustain electrodes Z so that initialization discharge can be stably performed and that brilliant point erroneous discharge caused by the generation of the strong discharge between the electrodes can be reduced.

In addition, pre-reset signals that gradually fall to a negative polar voltage in the pre-reset period before the reset period can be supplied to the scan electrodes Y and a positive polar bias voltage Vzb can be supplied to the sustain electrodes Z in the pre-reset period.

Figure 6:
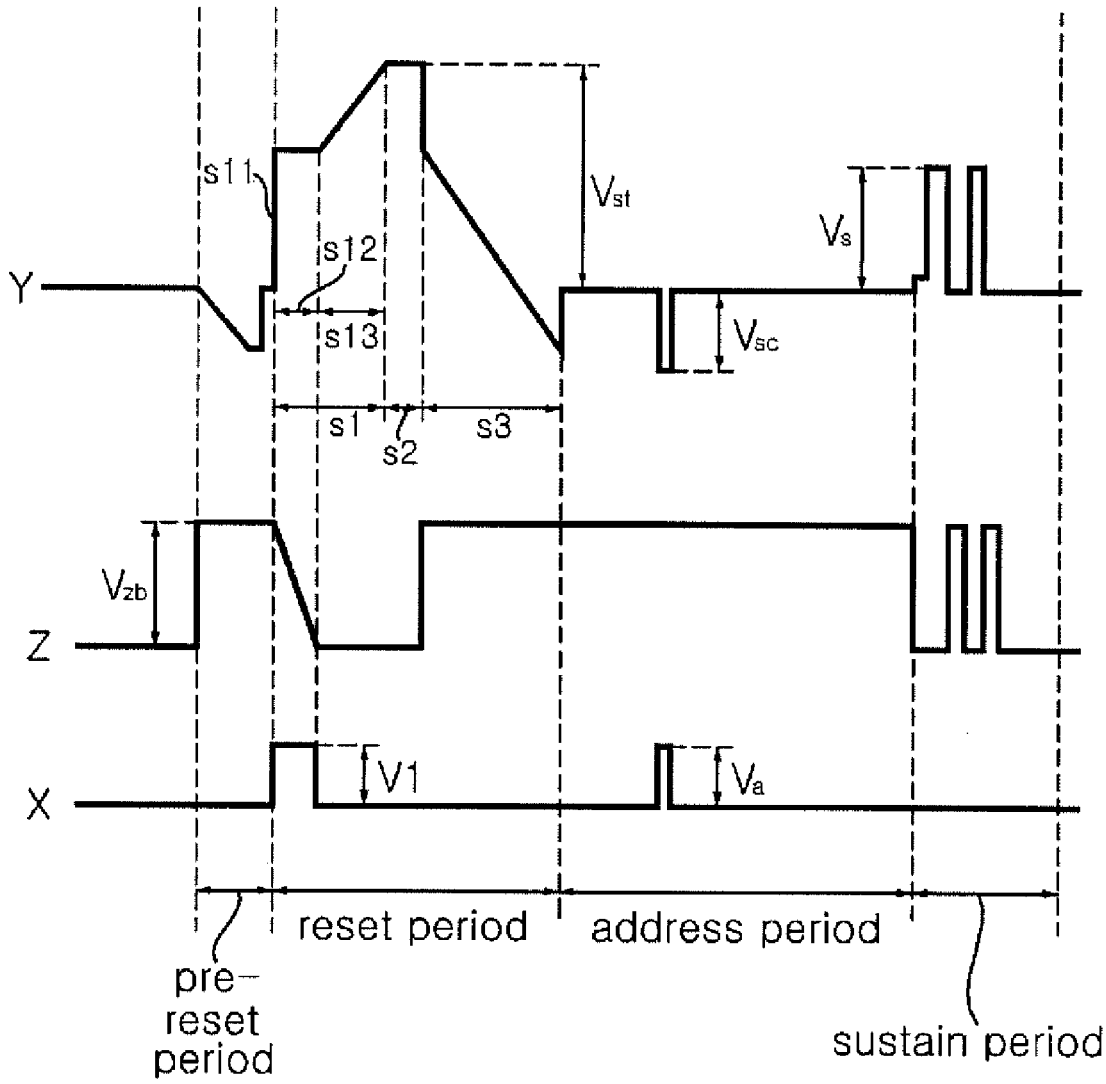

FIG. 6 is a timing diagram illustrating the waveforms of the driving signals according to the present invention according to an embodiment of the present invention.

Referring to FIG. 6, the rising period s1 of the reset signals can include a first rising period s11 that rapidly rises to a first rising voltage, a sustain period s12 for sustaining the first rising voltage, and a second rising period s13 that gradually rises to the highest voltage Vst.

A voltage supplied to the sustain electrodes Z sustains the bias voltage Vzb in the pre-reset period and can be gradually reduced from the bias voltage Vzb to a ground voltage GND in the sustain period s12 of the reset signals. Then, the bias voltage Vzb can be supplied to the sustain electrodes Z at the point of time where the falling period s3 starts to the point of time where the address period ends.

In addition, the positive polar voltage V1 can be supplied to the address electrodes X in the sustain period s12 where the voltage supplied to the sustain electrodes Z is gradually reduced.

As illustrated in FIG. 6, after the reset signals rapidly rise to the first rising voltage of a magnitude that may not generate the discharge between the scan electrodes Y and the address electrodes X in the first rising period s11, the voltage supplied to the sustain electrodes Z in the sustain period s12 is gradually reduced to generate weak discharge between the scan electrodes Y and the sustain electrodes Z and the voltage supplied to the scan electrodes Y is gradually increased to the highest voltage Vst in the second rising period s13 to generate the weak discharge between the scan electrodes Y and the sustain electrodes Z.

Unlike in FIG. 5, the voltage supplied to the scan electrodes Y is gradually increased to the highest voltage Vst in the second rising period s13 after the first rising period s11 to generate the weak discharge between the scan electrodes Y and the sustain electrodes Z. Then, the voltage supplied to the sustain electrodes Z is gradually reduced to generate the weak discharge between the scan electrodes Y and the sustain electrodes Z. In this case, the voltage supplied to the sustain electrodes Z in the second rising period s13 is sustained as the bias voltage Vzb.

As described above, the positive polar voltage V1 is supplied to the address electrodes X while the voltage supplied to the sustain electrodes Z is gradually reduced to prevent the generation of the discharge between the scan electrodes Y and the address electrodes X or the sustain electrodes Z and the address electrodes X and to effectively control the brilliant point erroneous discharge.

In addition, a period in which the voltage supplied to the sustain electrodes Z is gradually reduced may not coincide with the sustain period s12.

Figure 7:
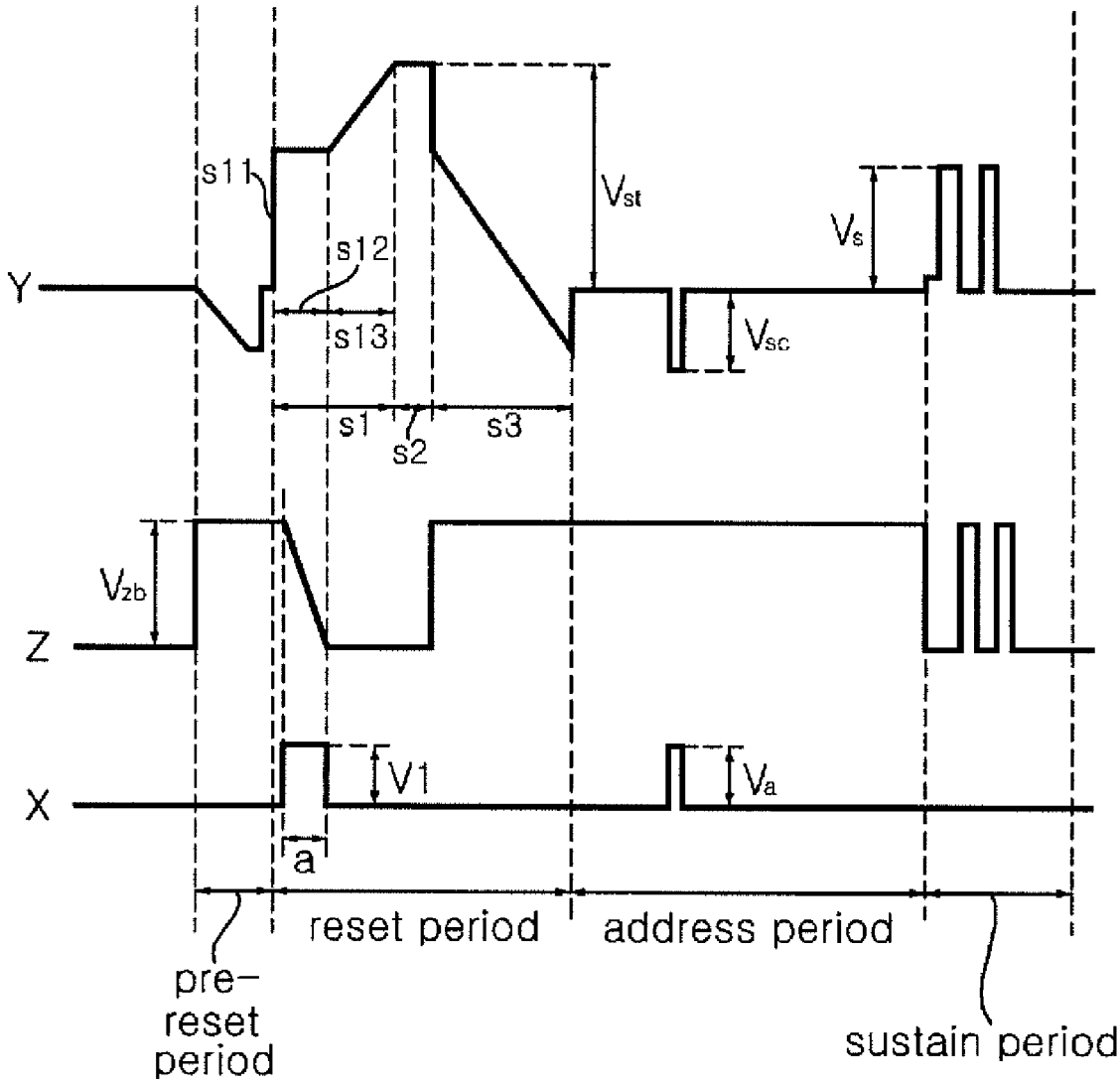

Referring to FIG. 7, a sustain falling period a in which the voltage supplied to the sustain electrodes Z is gradually reduced can be included in the sustain period s12.

That is, the voltage supplied to the sustain electrodes Z gradually starts to be reduced after the lapse of a uniform time from the starting point of time of the sustain period s12 so that the voltage supplied to the sustain electrodes Z can be reduced to the ground voltage before the ending point of time of the sustain period s12.

In addition, unlike in FIG. 7, the ending point of time of the sustain falling period a can be after the ending point of time of the sustain period s12.

In the above case, the positive polar voltage V1 is preferably supplied to the address electrodes X in the sustain falling period a.

Figure 8:
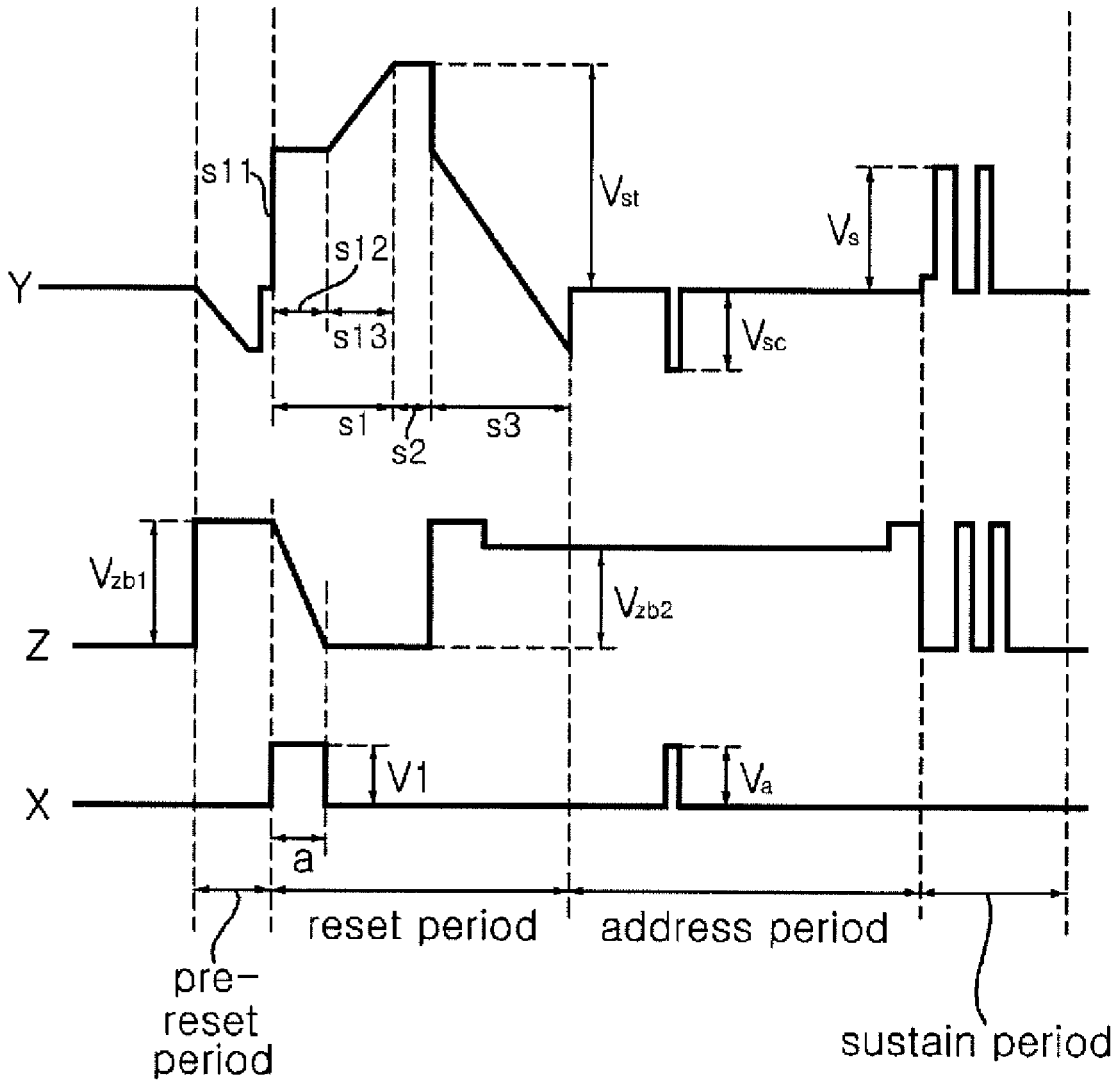

FIG. 8 is a timing diagram illustrating driving signal waveforms according to another embodiment of the present invention. Description of the same driving signal waveforms as the driving signal waveforms described with reference to FIGS. 5 to 7 among the driving signal waveforms illustrated in FIG. 8 will be omitted.

Referring to FIG. 8, the bias voltage supplied to the sustain electrodes Z in the falling period s3 can have a value no less than 2.

For example, a high bias voltage Vzb1 can be supplied to the sustain electrodes Z at the starting point of time of the falling period s3 and a bias voltage Vzb2 lower than the bias voltage Vzb1 can be supplied to the sustain electrodes Z after the lapse of a uniform time.

In the reset period, in the falling period s3, signals that gradually fall to the negative polar voltage are supplied to the scan electrodes Y to erase unnecessary charges among the wall charges formed in the scan electrodes Y in the rising period s1.

To be specific, in the falling period s3, the signals that gradually fall are supplied to the scan electrodes Y and the positive polar bias voltage is supplied to the sustain electrodes Z so that the weak discharge is generated between the scan electrodes Y and the sustain electrodes Z and that the unnecessary wall charges are erased by the discharge.

When the discharge in the falling period s3 is unstable, the unnecessary wall charges may not be erased so that the brilliant point erroneous discharge and the address erroneous discharge can be generated.

In addition, as the PDP is used for a long time, an MgO protective layer or a phosphor layer can be deteriorated so that the discharge characteristics of the PDP such as surface discharge and facing discharge can change. Therefore, as the time for which the PDP is used is increased, the possibility of generating the brilliant point erroneous discharge or the address erroneous discharge can be increased.

As illustrated in FIG. 8, as the high bias voltage Vzb1 is supplied to the sustain electrodes Z at the starting point of time of the falling period s3, the weak discharge between the scan electrodes Y and the sustain electrodes Z can be stabilized. Therefore, the brilliant erroneous discharge and the address erroneous discharge can be effectively controlled.

When the high bias voltage Vzb1 is supplied in the entire falling period s3, the brilliant point erroneous discharge can be generated in the falling period s3 due to the excessive generation of discharge.

That is, the discharge is excessively generated in the falling period s3 so that the brilliant erroneous discharge can be generated and the possibility of generating the brilliant erroneous discharge can be increased due to a change in the discharge characteristics caused by the increase in the time for which the PDP is used.

Therefore, as illustrated in FIG. 8, with the lapse of a uniform time after the falling period s3 starts, the bias voltage Vzb2 lower than the bias voltage Vzb1 is supplied to the sustain electrodes Z to control the amount of the discharge generated in the latter part of the falling period s3 and to prevent the generation of the brilliant erroneous discharge caused by the change in the discharge characteristics.

The high bias voltage Vzb1 supplied to the sustain electrodes Z in order to easily constitute the driving circuit and to stabilize the discharge in the falling period s3 can have the same level as the sustain voltage Vs or a similar level to the sustain voltage Vs. The bias voltage Vzb2 supplied after the bias voltage Vzb1 can be lower than the sustain voltage Vs in order to prevent the generation of the brilliant erroneous discharge.

In addition, the bias voltages Vzb1 and Vzb2 supplied to the sustain electrodes Z can be lower than the highest voltage V2 of the reset signals, the high bias voltage Vzb1 supplied to the sustain electrodes Z can be equal to the start voltage V1 in the falling period s3, and the low bias voltage Vzb2 supplied to the sustain electrodes Z can be lower than the start voltage V1 in the falling period s3.

In order to sustain a voltage difference no less than a uniform voltage between the scan electrodes Y and the sustain electrodes Z in the falling period s3 so that the unnecessary charges are erased by the generation of the surface discharge between the scan electrodes Y and the sustain electrodes Z, the bias voltages Vzb1 and Vzb2 supplied to the sustain electrodes Z are larger than a scan bias voltage supplied to the scan electrodes Y in the address period and are preferably larger than the absolute value of a scan voltage Vsc.

In at least one subfield (hereinafter, referred to as a half gradation subfield) among the plurality of subfields that constitute one frame, the sustain signal is not supplied, the sustain discharge is not generated, and only the scan signal and the data signal are supplied so that only the address discharge can be generated.

As described above, a low gradation of a lower level than the gradations that can be displayed by the sustain discharge can be displayed using the half gradation subfield in which only the address discharge is generated. That is, when it is assumed that the gradations that can be displayed by the sustain discharge are 0, 1, 2, . . . , and 255, decimal point gradations between 0 and 1 can be displayed using the half gradation subfield in which only the address discharge is generated.

Figure 9:
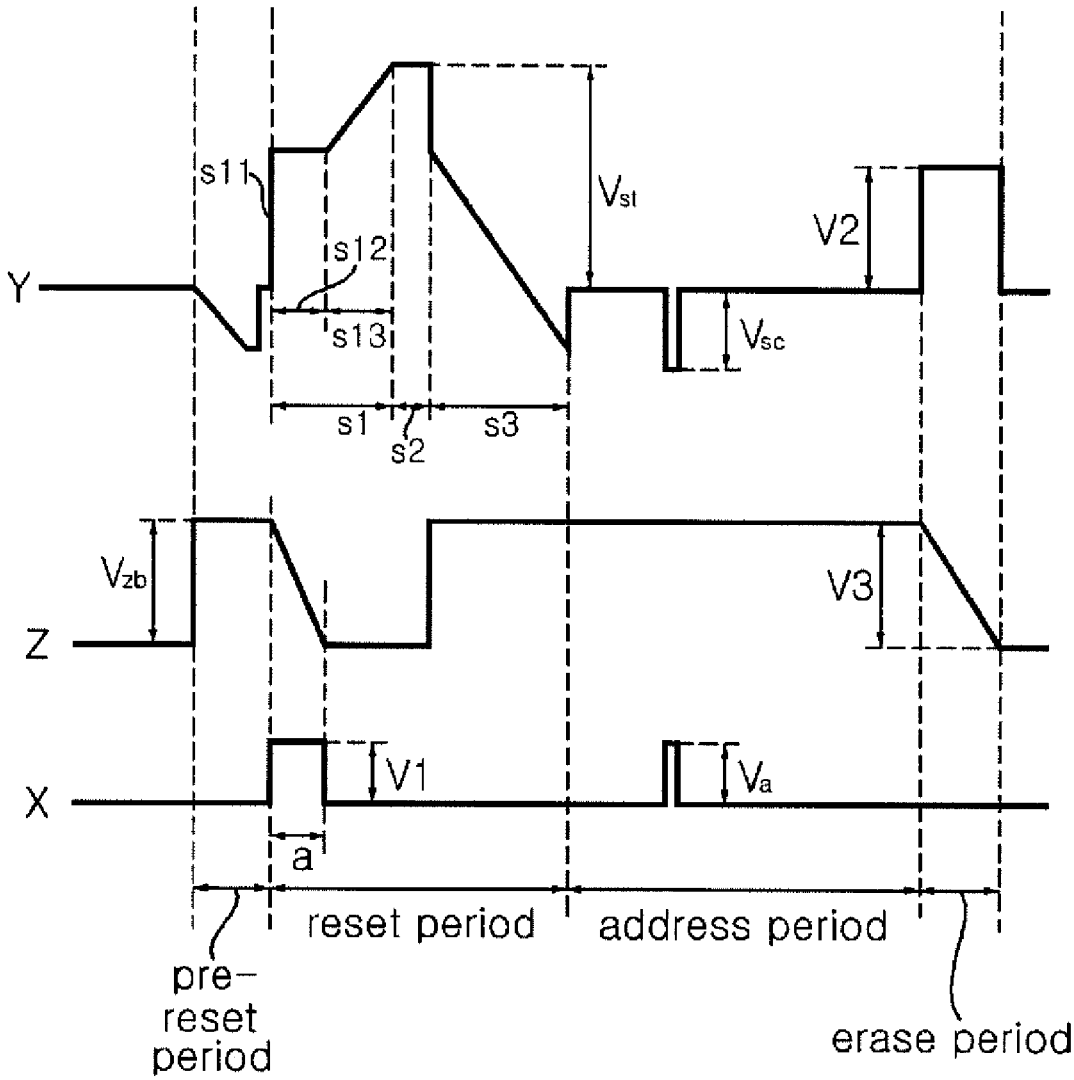

FIG. 9 illustrates driving signal waveforms according to another embodiment of the present invention, that is, the driving signal waveforms supplied from the half gradation subfield. Description of the same driving signal waveforms as the driving signal waveforms described with reference to FIGS. 5 to 7 among the driving signal waveforms illustrated in FIG. 9 will be omitted.

Referring to FIG. 9, in the erase period after the address period of the half gradation subfield, a uniform voltage V2 is supplied to the scan electrodes Y and the signals that gradually fall can be supplied to the sustain electrodes Z.

As described above, the uniform voltage V2 is supplied to the scan electrodes Y and the voltage supplied to the sustain electrodes Z is gradually reduced so that the discharge cells can be effectively initialized using the discharge between the scan electrodes Y and the sustain electrodes Z.

To be specific, the erase period illustrated in FIG. 9 is included in the half gradation subfield so that the discharge between the scan electrodes Y and the sustain electrodes Z can be generated while preventing the discharge between the scan electrodes Y and the address electrodes X and that the generation of the brilliant point erroneous discharge can be reduced.

A voltage V3 supplied to the scan electrodes Y in the erase period can be a positive polar voltage. In addition, in order to easily constitute the driving circuit and to improve discharge generation efficiency, the voltage V3 can be equal to the sustain voltage Vs. The falling slope of the voltage supplied to the sustain electrodes Z in the erase period can be the same as the falling slope of the voltage supplied to the scan electrodes Z in the falling period of the reset period.

In order to prevent the generation of the strong discharge between the scan electrodes Y and the sustain electrodes Z in the erase period, the voltage V2 supplied to the scan electrodes Y in the erase period can be equal to the voltage V3 first supplied to the sustain electrodes Z. Furthermore, the voltage V3 supplied to the sustain electrodes Z at the starting point of time of the erase period can be equal to the bias voltage Vzb supplied to the sustain electrodes Z and the voltage supplied to the sustain electrodes Z at the ending point of time of the erase period can be the ground voltage GND.

In addition, in order to prevent the generation of the discharge between the scan electrodes Y and the address electrodes X or between the sustain electrodes Z and the address electrodes X, the voltage V2 supplied to the scan electrodes Y in the erase period and the voltage V3 supplied to the sustain electrodes Z at the starting point of time of the erase period are preferably lower than the highest voltage Vst of the reset signals.

According to an embodiment of the present invention, the driving signal waveforms of the half gradation subfield illustrated in FIG. 9 can be applied to the first subfield among the plurality of subfields that constitute one frame.

Figure 10:
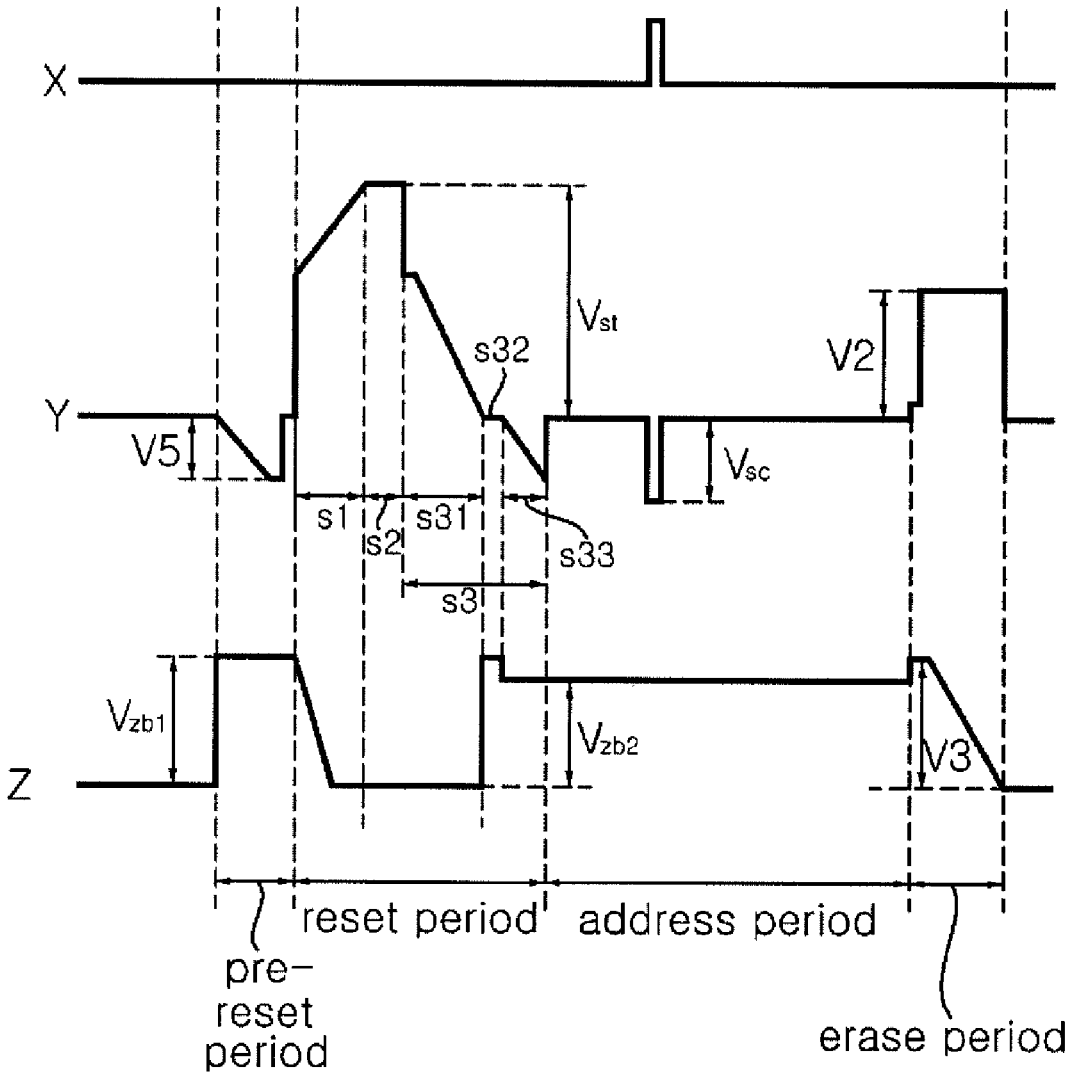

Referring to FIG. 10, the set down period s3 includes first and second set down periods s31 and s33 in which a voltage is gradually reduced and can include a sustain period s32 for sustaining a uniform voltage between the first and second set down periods s31 and s33.

In the first set down period s31, the ground voltage GND is supplied to the sustain electrodes Z. In the sustain period s32, the high bias voltage Vzb is supplied. In the second set down period s32, the low bias voltage Vzb2 can be supplied.

At this time, in order to stably generate the discharge in the set down period s3 so that the unnecessary charges are erased, the bias voltages Vzb1 and Vzb2 supplied to the sustain electrodes Z can be larger than the voltage supplied to the scan electrodes Y in the sustain period s32.

Figure 11:
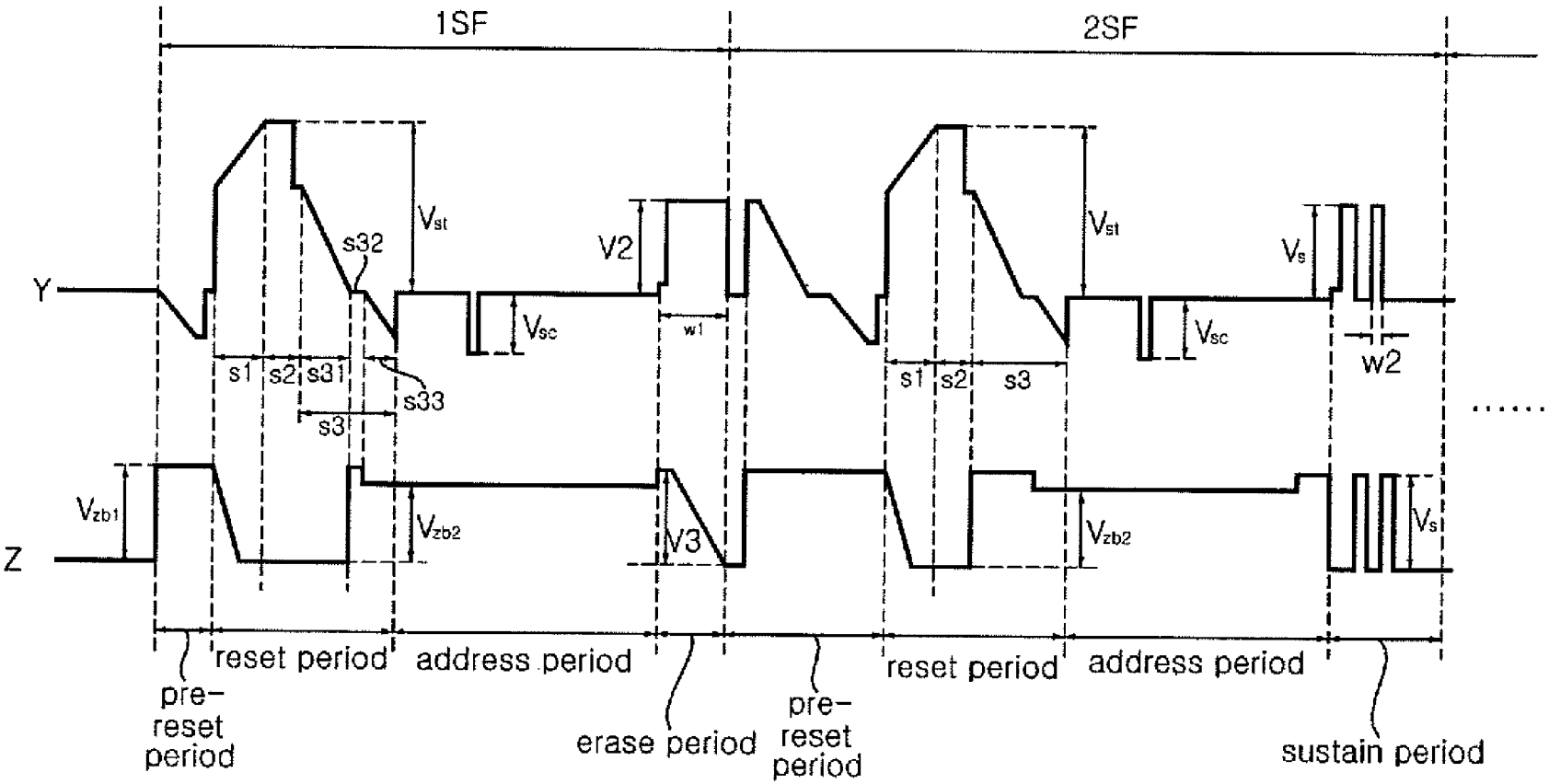

FIG. 11 illustrates driving signal waveforms according to another embodiment of the present invention, that is, the driving signal waveforms supplied from the first and second subfields among the plurality of subfields that constitute one frame.

Referring to FIG. 11, the first subfield is a half gradation subfield to which the sustain signals are not supplied and the sustain signals are alternately supplied to the scan electrodes X and the sustain electrodes Z in the second subfield.

As described above, in the first subfield that is the half gradation subfield, in the erase period, the positive polar voltage V3 is supplied to the scan electrodes X and the signals that gradually fall are supplied to the sustain electrodes Z.

The width w1 of the pulses supplied to the scan electrodes X in the erase period of the first subfield is preferably larger than the width w2 of the sustain signals supplied to the scan electrodes X in the sustain period of the second subfield. In addition, in order to stably perform initialization after the address discharge of the half gradation subfield, in the erase period of the first subfield, the width w1 of the pulses supplied to the scan electrodes X can be no less than three times the width w2 of the sustain signals of the second subfield.

When the widths of the plurality of sustain signals supplied in the second subfield are different from each other, the width w1 of the pulses supplied to the scan electrodes X in the erase period of the first subfield is preferably larger than the maximum width of the sustain signals supplied from the second subfield.

In addition, the time for which the high bias voltage Vzb1 is supplied to the sustain electrodes Z in the set down period s3 of the first subfield can be shorter than the time for which the high bias voltage Vzb1 is supplied to the sustain electrodes Z in the set down period s3.

For example, as illustrated in FIG. 11, the high bias voltage Vzb1 is supplied to the sustain electrodes Z in the sustain period s32 of the set down period s3 in the first subfield and the high bias voltage Vzb1 is supplied to the sustain electrodes Z in the first set down period s31 and the sustain period s32 of the set down period s3 in the second subfield.

The generation of the brilliant point erroneous discharge in the first subfield that is the half gradation subfield can be prevented by controlling the time for which the high bias voltage Vzb1 is supplied to the sustain electrodes Z.

In addition, the pre-reset periods can be included before the reset periods of the first and second subfields and the pre-reset signals that fall to the negative polar voltage in the pre-reset periods can be supplied to the scan electrodes X.

As illustrated in FIG. 11, in the pre-reset period of the second subfield, a first pre-reset signal that gradually falls from the positive polar voltage to the ground voltage GND and a second pre-reset signal that gradually falls from the ground voltage GND to the negative polar voltage can be sequentially supplied to the scan electrodes X.

Although not shown in FIG. 11, the sustain signals can be supplied in the subfields after the third subfield.

According to the present invention, the gradually falling signals are supplied to the sustain electrodes in the rising period of the reset signals to secure the driving margin of the PDP and the positive polar voltage is supplied to the address electrodes to stably perform the initialization discharge and to reduce the erroneous discharge of the plasma display device.

In addition, according to an embodiment of the present invention, the subfields in which the sustain signals are supplied are constituted so that the low gradation display ability of an image can be improved. On the other hand, in the subfields for displaying low gradations, the gradually falling signals are supplied to the sustain electrodes to erase the wall charges caused by the address discharge, to effectively initialize the discharge cells, and to reduce the erroneous discharge of the plasma display device.

Although embodiments of the present invention have been described with reference to drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. A plasma display device comprising:

a plasma display panel including a plurality of scan electrodes and sustain electrodes formed on an upper substrate and a plurality of address electrodes formed on a lower substrate; and a driving unit for supplying driving signals to the plurality of electrodes, wherein, in at least one subfield among a plurality of subfields that constitute one frame, reset signals supplied to the scan electrodes comprise a rising period that rises from a reference voltage to a highest voltage, and wherein a sustain falling period in which a voltage supplied to the sustain electrodes is gradually reduced at least partially overlaps the rising period.

2. The plasma display device of claim 1, wherein a starting point of time of the sustain falling period is later than a starting point of time of the rising period.

3. The plasma display device of claim 1, wherein an ending point of time of the sustain falling period is before an ending point of time of the rising period.

4. The plasma display device of claim 1, wherein the rising period of the reset signals comprises a first rising period that rises from the reference voltage to a first voltage and a second rising period that rises from the first voltage to the highest voltage with a smaller slope than the slope of the first rising period, and wherein the ending point of time of the sustain falling period is before the starting point of time of the second rising period.

5. The plasma display device of claim 1, wherein the rising period of the reset signals comprises a first rising period that rises from the reference voltage to the first voltage, a sustain period for sustaining the first voltage, and a second rising period that rises from the first voltage to the highest voltage with a smaller slope than the slope of the first rising period, and wherein the sustain falling period overlaps the sustain period.

6. The plasma display device of claim 5, wherein the length of the sustain falling period is shorter than the length of the sustain period.

7. The plasma display device of claim 1, wherein the voltage supplied to the sustain electrodes in the sustain falling period is gradually reduced from a second voltage to a third voltage, and wherein the second voltage is substantially equal to a sustain voltage.

8. The plasma display device of claim 1, wherein the reset signals comprise a set down period in which a voltage is gradually reduced after the rising period, and wherein a falling slope of the voltage supplied to the sustain electrodes in the sustain falling period is substantially equal to a falling slope of the reset signals in the set down period.

9. The plasma display device of claim 1, wherein a bias voltage supplied to the sustain electrodes after the rising period of the reset signals has a value no less than 2.

10. The plasma display device of claim 9, wherein a first bias voltage and a second bias voltage lower than the first bias voltage are sequentially supplied to the sustain electrodes after the rising period of the reset signals.

11. The plasma display device of claim 10, wherein the voltage supplied to the sustain electrodes in the sustain falling period gradually falls from the second voltage to the third voltage, and wherein the second voltage is substantially equal to the first bias voltage.

12. The plasma display device of claim 1, wherein pre-reset signals that gradually fall to a negative polar voltage are supplied to the scan electrodes before the reset signals are supplied, and wherein the falling slope of the voltage supplied to the sustain electrodes in the sustain falling period is substantially equal to the falling slope of the pre-reset signals.

13. A plasma display device comprising:

a plasma display panel including a plurality of scan electrodes and sustain electrodes formed on an upper substrate and a plurality of address electrodes formed on a lower substrate; and a driving unit for supplying driving signals to the plurality of electrodes, wherein, in at least one subfield among a plurality of subfields that constitute one frame, reset signals supplied to the scan electrodes comprise a rising period that rises from a reference voltage to a highest voltage, wherein a sustain falling period in which a voltage supplied to the sustain electrodes gradually falls at least partially overlaps the rising period, and wherein a positive polar voltage is supplied to the address electrodes in the sustain falling period.

14. The plasma display device of claim 13, wherein the voltage supplied to the sustain electrodes in the sustain falling period gradually falls from a second voltage to a third voltage, wherein a voltage supplied to the address electrodes sustains a positive polar fourth voltage, and one of the second voltage and the fourth voltage is lower than the highest voltage of the reset signals.

15. The plasma display device of claim 14, wherein the fourth voltage is substantially equal to an address voltage.

16. A plasma display device comprising:

a plasma display panel including a plurality of scan electrodes and sustain electrodes formed on an upper substrate and a plurality of address electrodes formed on a lower substrate; and a driving unit for supplying driving signals to the plurality of electrodes, wherein, in a first subfield among a plurality of subfields that constitute one frame, a voltage supplied to the sustain electrodes in an at least partial period of a reset period is gradually reduced, and wherein a positive polar voltage is supplied to the scan electrodes and the voltage supplied to the sustain electrodes is gradually reduced in an erase period after an address period.

17. The plasma display device of claim 16, wherein the first subfield does not comprise a sustain period in which a pair of sustain signals are supplied to the scan electrodes and the sustain electrodes.

18. The plasma display device of claim 16, wherein the first subfield is a first subfield among the plurality of subfields.

19. The plasma display device of claim 15, wherein the length of the erase period is larger than a width of the sustain signals supplied in a sustain period of a second subfield among the plurality of subfields.

20. The plasma display device of claim 15, wherein the voltage supplied to the sustain electrodes in the erase period is gradually reduced from a fifth voltage to a sixth voltage, and wherein the sixth voltage is higher than a bias voltage supplied to the sustain electrodes in the address period.

* * * * *